US005113731A

United States Patent [19]

Reist

[11] Patent Number: 5,113,731

[45] Date of Patent: May 19, 1992

[54] METHOD AND APPARATUS FOR CUTTING PRINTED PRODUCTS

[75] Inventor: Walter Reist, Hinwil, Switzerland

[73] Assignee: Ferag AG, Hinwil, Switzerland

[21] Appl. No.: 790,026

[22] Filed: Nov. 6, 1991

Related U.S. Application Data

[63] Continuation of Ser. No. 407,615, Sep. 15, 1989, abandoned.

[30] Foreign Application Priority Data

Oct. 31, 1988 [CH] Switzerland ..... 04046/88

[51] Int. Cl.[5] ..... B26D 1/22; B26D 9/00

[52] U.S. Cl. ..... 83/35; 83/39; 83/404.2; 83/407; 83/409.1; 83/418; 83/425.1; 83/435.1; 83/934

[58] Field of Search ..... 83/29, 35, 39, 410.8, 83/411.1, 411.3, 411.5, 411.6, 422, 426, 431, 435, 435.1, 435.2, 733, 404.1, 404.2, 418, 407, 404, 409, 409.1, 934, 425.1

[56] References Cited

U.S. PATENT DOCUMENTS

| | | | |
|---|---|---|---|
| 1,177,146 | 3/1916 | Sheehan | 83/407 |
| 2,245,868 | 6/1941 | Melby | 83/409.1 |
| 3,329,053 | 7/1967 | Kleineberg | 83/700 |
| 3,340,758 | 9/1967 | Peterson et al. | 83/699 |
| 3,496,816 | 2/1970 | Doerfler et al. | 83/404 |
| 3,884,102 | 5/1975 | Faltin | 83/435.2 |
| 4,030,394 | 6/1977 | Kistner et al. | 83/409 |
| 4,046,043 | 9/1977 | Kistner et al. | 83/430 |
| 4,669,347 | 6/1987 | Worner | 83/422 |
| 4,669,644 | 6/1987 | Nilsson | 83/408 |

FOREIGN PATENT DOCUMENTS

| | | | |
|---|---|---|---|
| 2102717 | 2/1983 | United Kingdom | 83/474 |

*Primary Examiner*—Hien H. Phan
*Attorney, Agent, or Firm*—Walter C. Farley

[57] ABSTRACT

For cutting multilayer printed products in a continuous process single or multiple printed products 92) are associated with a first knife part (3) which is moved together with the printed products. During the movement, the printed products and the first knife part are engaged along a cutting edge (4) and subsequently moved past a second knife part (5). Through the cooperation between the first (3) and second (5) knife parts, the printed products (2) are cut along the intended cutting edge (4). A corresponding apparatus has a plurality of conveying units for the printed products moving along a circular path. The conveying units are preferably constructed as counterknives while the associated cutting knives are fixed. Thus, even when large quantities are conveyed and the printed products are thick, a top-quality three-sided cut is obtained.

21 Claims, 7 Drawing Sheets

I
II
III
IV

METHOD AND APPARATUS FOR CUTTING PRINTED PRODUCTS

CROSS REFERENCE TO RELATED CASE

This application is a continuation of U.S. Pat. application Ser. No. 407,615 filed Sept. 15, 1989, now abandoned.

FIELD OF THE INVENTION

The present invention relates to a method and an apparatus for cutting multi-layer printed products conveyed in a continuous stream.

BACKGROUND OF THE INVENTION

Multilayer, particularly singly or multiply folded printed products, e.g. magazines, must generally be cut or trimmed on at least one and usually on two or three sides. In the case of industrial flow-line production of such printed products, which are generally conveyed away from the rotary press in the form of a scale or stream flow, every effort is made to integrate the cutting process into the dynamic production process, i.e. to cut at a speed which matches the maximum rotary press capacity of e.g. 80,000 copies per hour.

Numerous cutting means are already known. Thus, e.g. Swiss patent 650 967 and European patent 0 017 878 in each case disclose an apparatus for the lateral cutting of paper sheets, in which the sheets are conveyed in a scale or imbricated flow on a planar conveyor belt against one or more rotary cutting knives or blades and are laterally cut by the latter. Although this generally leads to acceptable cutting results, the said apparatuses suffer from certain disadvantages. Thus, it is difficult and complicated to precisely orient the individual printed products in the scale flow. In addition, in the latter a gap is formed between the individual products and the substrate, which particularly in the case of thicker articles, leads to tears in the cutting edges, particularly of the first pages, as well as to irregular cutting tracks. If the products are not only to be cut on the sides parallel to the conveying direction, then the scale flow must be turned by 90° or the printed products must be individually turned, which is prejudicial to the optimum spatial arrangement of the production line and is also technically complicated.

Knowing that cutting in a scale flow suffers from various disadvantages and normally does not satisfy the need for a high-quality cut, the Applicant has already made a number of proposals, in which the printed products are not cut in the scale flow.

In conjunction therewith, Swiss patent application 4876/85-4 (now Swiss Patent 668,216) discloses an apparatus for the three-sided cutting of printed products with a path revolving continuously about two drive wheels and having a plurality of compartments, each serving to receive a printed product. Along the straight portions of the rotary path are positioned three cutting devices with a plurality of cutting knives and counterknives arranged pairwise parallel to the path and past which the printed products are moved and correspondingly cut. Fundamentally this leads to a good cut, even in the case of thick printed products However, it has proved disadvantageous that the precise, straight guidance of the rotary path absolutely necessary for an exact cut is technically complicated and that the cutting devices require a relatively large amount of maintenance.

A further apparatus according to U.S. Pat. No. 4,038,893, in which the printed products are individually cut, comprises a rotary bucket or compartment wheel, whose individual buckets or compartments each receive a single printed product and which is provided with movalbe knives operable by means of common control cans and counterknives cooperating therewith. This apparatus is relatively complicated in construction and therefore expensive to maintain.

It has been found that the known cutting procedures in the case of dynamic high-capacity processes do not meet the quality demands, or only do this at the cost of high constructional expenditure. However, it is never possible to achieve such high cutting qualities as in static or alternating processing operations, where highly developed cutting procedures are known ensuring excellent results through the careful guidance of the cutting forces. Thus, e.g. complete paper packs resting on a fixed substrate acting as the counterknife are cut with excellent accuracy by a vibrating or cutting knife, which cuts the product on a precisely defined path (e.g. logarithm form).

SUMMARY OF THE INVENTION

The object of the invention is to obviate these disadvantages. An object of the invention is therefore to provide a reliable and precise method, as well as a simple, easy maintenance and inexpensive apparatus making it possible to ensure top-quality cutting of multilayer printed products in a continuous passage process, particularly a high-capacity production process.

In conventional dynamic cutting processes, as stated hereinbefore, either the printing products are continuously or individually supplied to a cutting device, in which the knife and counterknife are fixed, or there are numerous cutting devices moving at least temporarily with the printed product and which also comprise a knife and counterknife in each case. These known cutting devices, no matter whether they are fixed or rotating, consequently always comprise two parts, namely a knife and a counterknife, which are associated with one another pairwise and in fixed manner. The invention adopts a new procedure, in that it breaks up the standard knife-counterknife unit, arranges and moves the two knife parts independently of one another, one knife part being fixed relative to the cut material and is only brought temporarily into a clearly defined cutting engagement. Thus, a cutting method comparable to the aforementioned static method is integrated into a dynamic process.

The main advantages of the invention are that on the one hand the necessary throughput for a dynamic high capacity process is obtained and simultaneously, as a result of the knife parts (preferably counterknives) fixed relative to the cut material, it is possible to obtain a cutting quality comparable with that of static cutting methods. Through an appropriate choice and arrangement of the second knife parts (preferably cutting knives), it is possible, as a function of the characteristics, size and thickness of the printed products to be cut, to fix the cutting curve much as in the aforementioned static cutting devices, in such a way that there is an optimum distribution of the cutting forces over the entire cut edge. Thus, it is possible to combine the quality advantages of a static cutting process and the capacity advantages of a dynamic cutting process. In addition, through the corresponding arrangement of three cutting knives, the printed products can be cut on three sides in a single pass, without it being necessary to turn the product stream.

BRIEF DESCRIPTION OF THE DRAWINGS

The invention is described in greater detail hereinafter relative to a non-limitative embodiment and the attached drawings, wherein.

DESCRIPTION OF THE PREFERRED EMBODIMENTS

Figures 1A, 1B, 3:
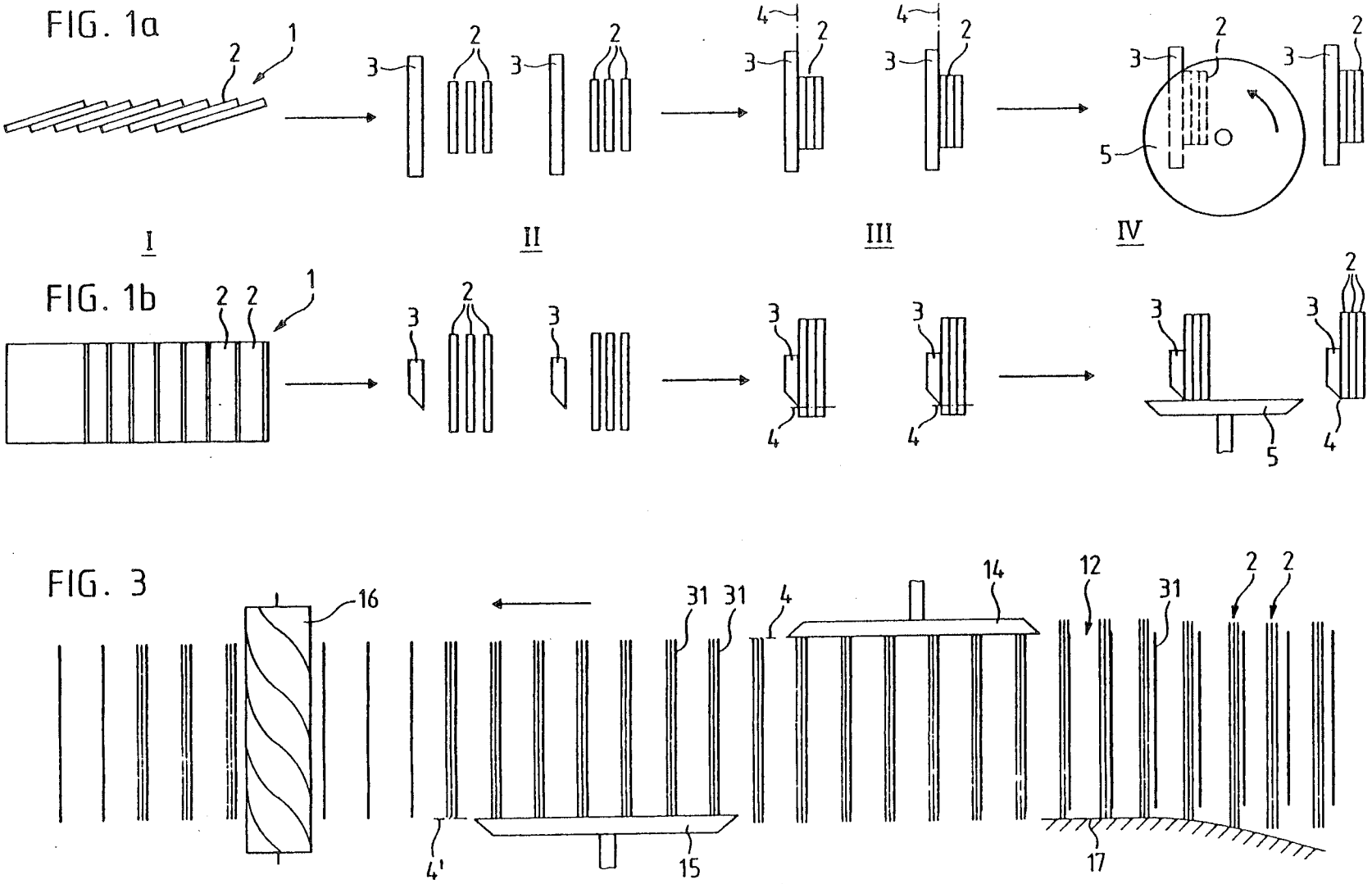
FIG. 1*a* is a schematic side view of an apparatus performing the sequence of steps in the inventive method.
FIG. 1*b* is a schematic top view of the sequence of FIG. 1*a;*
FIG. 3 is a developed (linear) representation of the apparatus of FIG. 2.

FIGS. 1*a* and 1*b* show the principle of the inventive method. FIG. 1*a* views the spatial sequence from the side. For a better understanding of the same sequence, FIG. 1*b* shows it from above. Phase I represents the printed product 2 conveyed in a scale flow 1, i.e. with the products to be cut partly overlapping one another, such as are normally conveyed away from a rotary press. The scale flow is broken up and then each individual or, as in the representation, several printed products are jointly associated with a first knife part 3 moving together with the printed products (phase II). The printed products conveyed in the scale flow 1 can obviously already consist of a plurality of components. The printed products designated 2 in the drawing can consist of several individual products, e.g. superimposed journals or parts of a newspaper inserted in one another. When reference is made hereinafter to "printed product", this is understood to mean one or more individual products combined (possibly only temporarily) into a unit.

The printed products and the associated first knife part 3 are oriented along a cutting edge 4 and engaged (phase III) and moved past a second knife part 5. The first 3 and second 5 knife parts are brought into cutting engagement, so that the printed products 2 are cut along edge 4 (phase IV). The second knife part 5 is represented in FIG. 1 as a fixed, rotating cutting knife which rotates about a fixed axis.

It obviously falls within the scope of the invention to give the second knife part a different form and operation. Thus, the second knife part can e.g. be in the form of a stationary, non-rotating blade or a movable, non-fixed knife part. Although the rotating knife part 3 is preferably constructed as a counterknife and knife part 5 as the actual cutting knife, their functions are naturally also interchangeable. It is also unimportant for the presently described method, whether the printed products are fed in as a scale flow or in some other form. Thus, the printed products can be individually or groupwise supplied from a preceding operation.

The printed products are advantageously moved past the knife part 5 in such a way that the lateral edge, after cutting, is substantially at right angles to the surface of the printed product.

A preferred embodiment of an inventive apparatus for the three-sided cutting of multilayer printed products will now be described relative to FIG. 2. In order to stress the important points, the drawing is limited to a largely schematic representation. A drum rotor 11 rotating about a fixed shaft 13 is provided on its periphery with a plurality of preferably radially arranged, lateral cells or compartments 12, which are open to the outside. The multilayer printed products 2, which are fed in in the form of a scale flow in the direction of arrow A, are individually inserted by a conveying-in mechanism (not shown) into one of these compartments. The printed products in the compartments 12 are firstly moved past a fixed cutting device 14 as a result of the rotation of drum rotor 11 and said device cuts the lateral edge remote from the observer. The lateral edge of the printed product facing the observer is then cut by means of a second cutting device 15. In the selected example, the cutting devices 14 and 15 are constructed as disk-like, rotary cutting knives. Lastly, using a third cutting device 16, e.g. a cutting roller, the upper edge of the printed product is cut and then the now three-sided cut printed product is removed by a not shown conveying-away device from the compartments 12 and conveyed on in the direction of arrow B.

The compartments 12 of drum rotor 11 are separated from one another by preferably radially directed compartment walls 31, each of which is provided with three counterknives cooperating with the cutting devices 14, 15 and 16 or is directly constructed as counterknives.

A detailed embodiment will be described hereinafter with reference to FIGS. 8 to 12.

Unlike in the case of other conceivable embodiments of apparatus for accomplishing claimed method, the advantage of the specific construction described here is that the drum rotor permits in simple manner a clearly defined, precise guidance of the counterknives cooperating with the fixed cutting knives and consequently it is possible to achieve a constant cutting quality. The greater the number of cells or compartments of the drum rotor, the higher the conveying capacity of the apparatus, assuming a constant rotational speed. Although, in principle, a single compartment would be sufficient for performing the method, a plurality of such compartments is preferred for the specific apparatus.

With regards to the aforementioned conveying in and away mechanisms, which form interfaces between the inventive apparatus and the remaining production process, reference can be made to known constructions (e.g. to the overhead conveyor of Swiss patent application 4 876/85-4), which, as a function of the specific requirements and applications, can be adapted to the topology of the surroundings.

Figure 2:
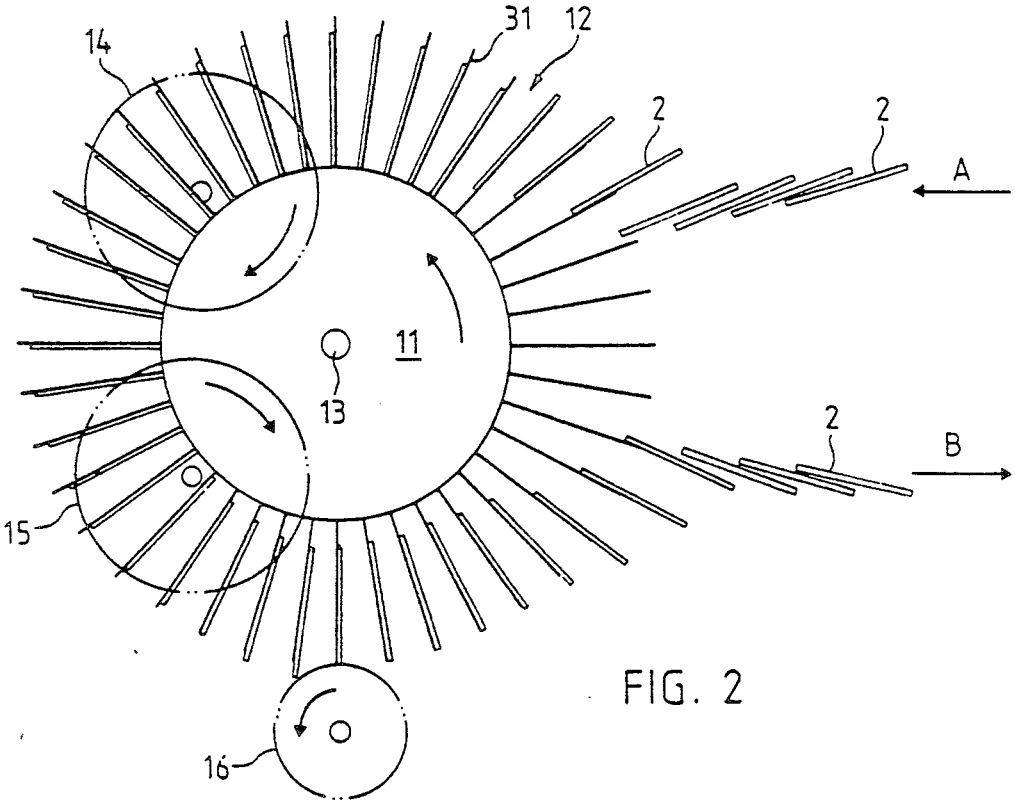
FIG. 2 is a schematic side elevation of a preferred construction of the inventive apparatus.

FIG. 3 shows the apparatus of FIG. 2 in a development, the conveying direction being indicated by an arrow. The uncut printed products 2 placed in compartments 12 and projecting laterally over the sane are positioned therein e.g. by means of a lateral cam 17, so as to create a clearly defined position of the printed products, particularly the edges to be cut 4, 4', with respect to the cell or compartment wall 31, which here simultaneously acts as the counterknife, and the cutting knife 14. It is obviously possible to provide further cams (on the other side of the printed products or upstream of the second cutting knife 15). The printed products can also be fixed by a clamping mechanism in their compartments in such a way that they cannot be moved until they have passed the second cutting knife 15.

Figure 4:
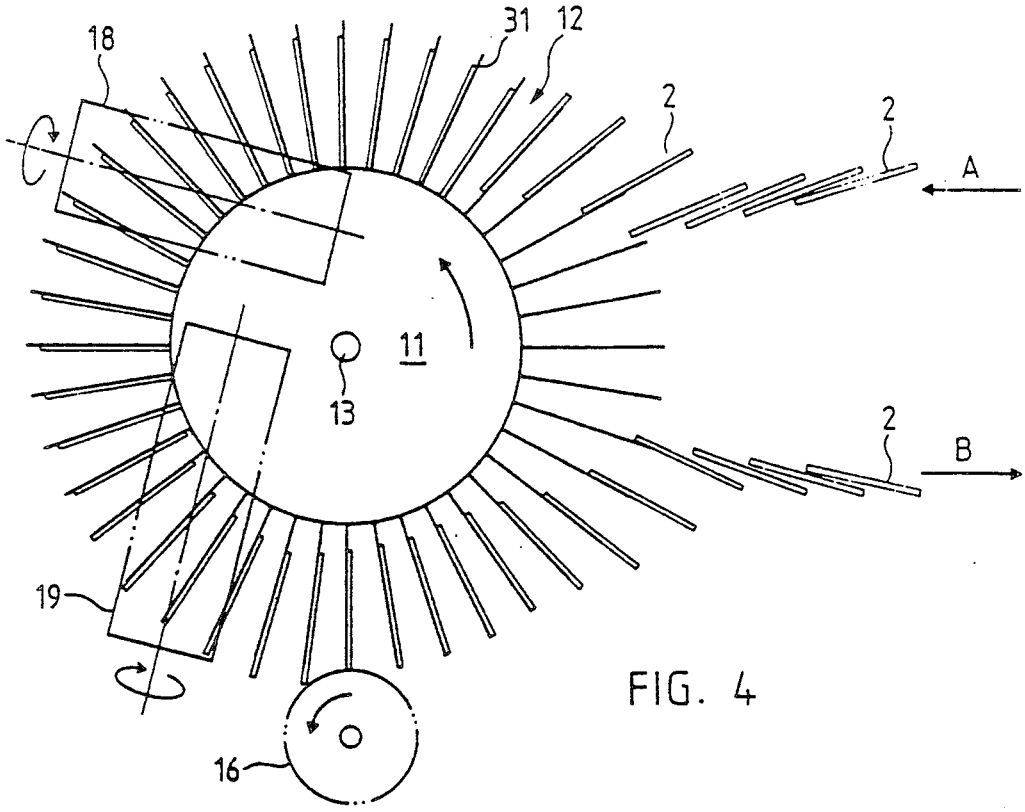
FIG. 4 is a schematic side elevation of another embodiment of the inventive apparatus.

A similar apparatus to that discussed hereinbefore is shown in FIG. 4. The function of the cutting knives 14 and 15 is fulfilled by rotary cutting rollers 18, 19 positioned laterally of the drum rotor 11. The rotation axes of these cutting rollers are preferably at right angles to the rotary shaft 13, but in such a way that they do not intersect the same, so that on considering an individual printed product, it is not simultaneously cut on a complete lateral edge and is instead cut continuously and in an identical manner to that described in connection with cutting knives 14, 15 from one end to the other of said lateral edge. In the selected representation, the lateral edges of the printed products are consequently cut from the inside to the outside.

Obviously the cutting devices 14, 15 and 18,19 provided at different locations in the representation can face one another, i.e. so that the leading and trailing edge cut will take place simultaneously. The arrows A and B, as well as the indication of the rotation direction of the drum rotor 11 are not prescribed. The apparatus can also be operated in the reverse sense.

It must be stressed that the invention makes it possible to in particular arrange the lateral cutting devices 14, 15 and 18, 19 in such a way that they can be utilized in an optimum manner in that, as shown in FIG. 2, a single cutting knife is simultaneously engaged with three or four printed products. Furthermore, the edge of a printed product is continuously cut from one end to the other (here from the inside to the outside), which assists the provision of a high cutting quality. The surface of the cutting roller 16 is e.g. provided with spiral cutting edges, so that the printed products are cut at a similar favorable cutting angle corresponding to the pitch of the spiral, to that with circular cutting knives.

The term "fixed" used hereinbefore in connection with the cutting knives and rollers naturally does not exclude the cutting devices being adjustable with respect to the drum rotor, as a function of the printed product and the desired cut. It is intended to mean that the position of the cutting devices does not change during operation.

Figure 5A:
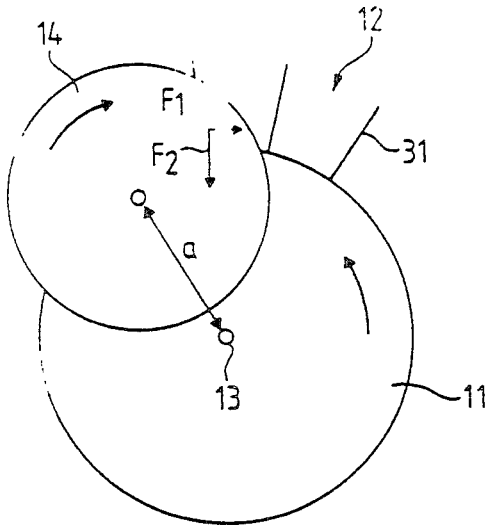
FIGS. 5*a* and 5*b* are schematic elevations of apparatus in accordance with the invention illustrating the influence of the arrangement of the cutting knives on the cutting forces.
Figure 5B:
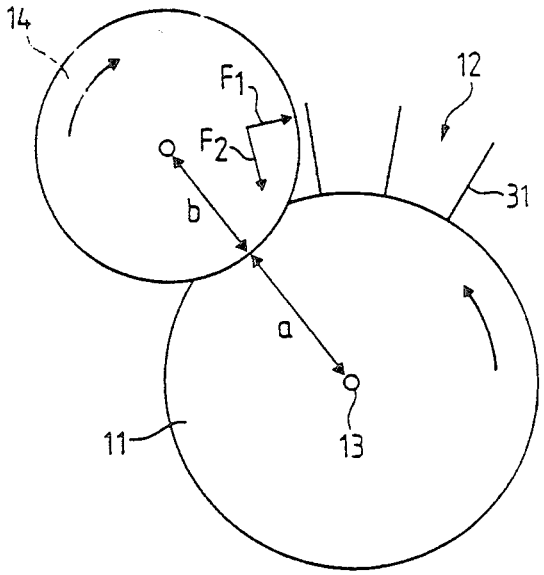

FIGS. 5*a* and 5*b* diagrammatically show how, by an appropriate arrangement of the cutting knife with respect to the drum rotor 11 and through the choice of the rotation direction, it is possible to influence and utilize the cutting forces acting on the printed products. In FIG. 5*a*. the rotation axis of the cutting knife 14 is relatively near, namely at a distance a, from the rotary spindle 13 of the drum rotor 11. Thus, the printed products are continuously cut from the inside to the outside (relative to the drum rotor). In FIG. 5*b* the cutting knife is outwardly displaced by an additional distance b. In this case the printed products are cut continuously from the outside to the inside. By modifying the rotation directions of the drum rotor and/or the cutting knife, it is possible to vary the direction and amount of the cutting forces $F_1$ (tangential) and $F_2$ (radial) acting on the printed products, as a function of the application. Through an appropriate choice of these cutting forces, the printed products are automatically held in compartment 12.

Figure 6:
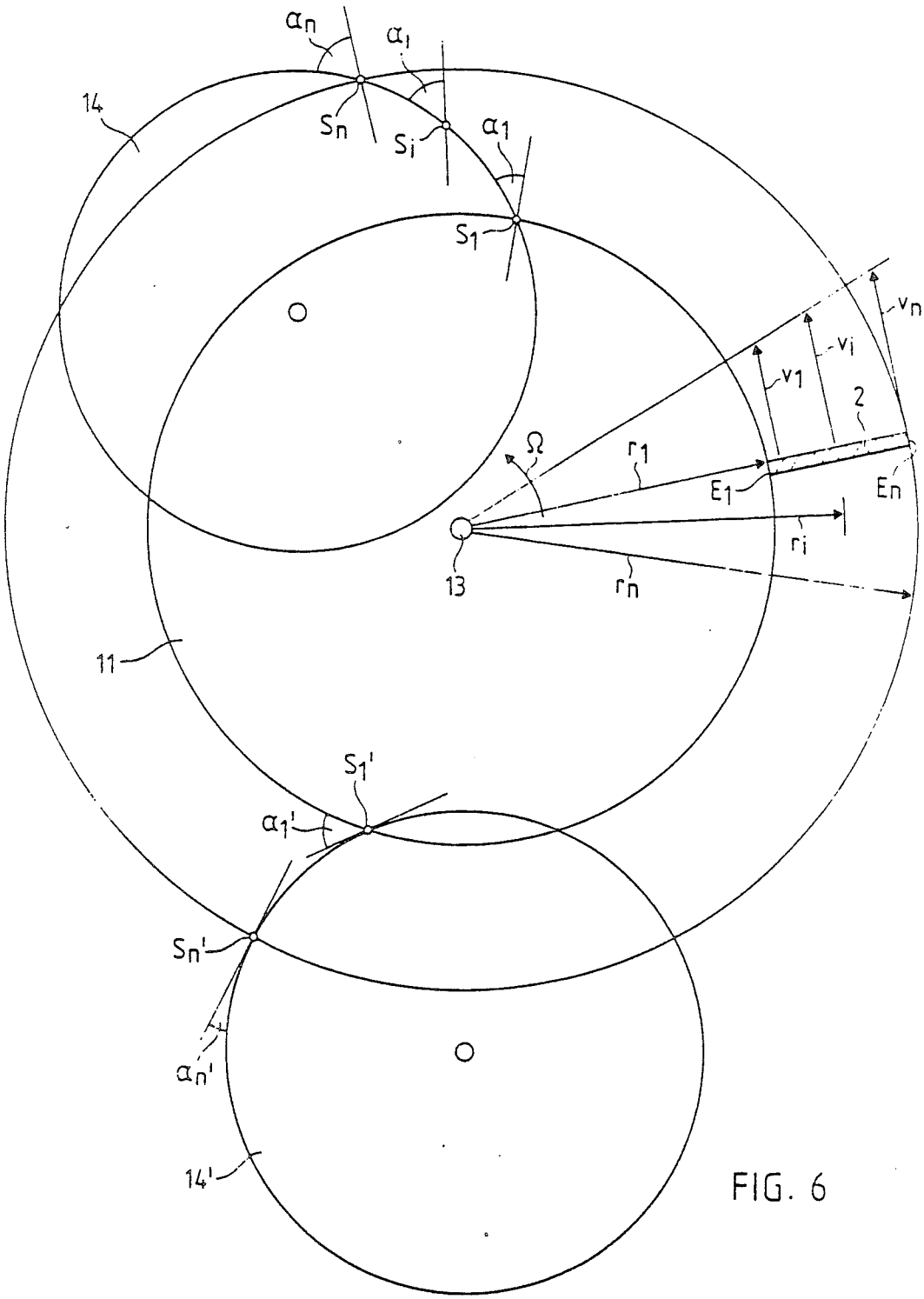
FIG. 6 is a schematic representation illustrating the influence of the arrangement of the cutting knives on the cutting geometry.

FIG. 6 reveals the influence of the arrangement of the cutting knives on the cutting geometry. A single printed product 2, which is located on the periphery of drum rotor 11 rotating at a constant angular speed $\Omega$, moves at a higher speed at its outer end $E_n$ than at its inner end $E_1$ facing the rotary spindle 13. There is a linear speed profile $v_i = r_i \cdot \Omega$ dependent on the distance from the rotation axis. During the cutting process at the first cutting device 14 (corresponding to that of FIG. 5*a*), the printed product is firstly cut at its inner end $E_1$ by point $S_1$ of cutting knife 14 and then at its outer end $E_n$ by point $S_n$. The cutting angle $\alpha_1$ at $S_1$ is significantly more shallow than the cutting angle $\alpha_n$ at $S_n$. During the cutting process at the second cutting device (corresponding to that of FIG. 5*b*), the printed product is cut from the outside to the inside (from $E_n$, $S_n'$ to $E_1$, $S_1'$). The cutting angle $\alpha_n'$ at $S_n'$ is much shallower than the cutting angle $\alpha_1'$ at $S_1'$. However, in both cases the printing product speed at $S_n$ is higher than at $S_1$ ($v_n > v_1$). Through appropriate positioning of the cutting knife 14, it is possible to choose the cutting angle and speed as a function of the specific circumstances and requirements, so as to achieve an appropriate cutting geometry and therefore an optimum cutting quality. Through an appropriate combination and variation of ($\alpha_i$, $v_i$) over the entire cutting edge it is possible, as in the aforementioned static cutting methods, to obtain cutting curves adapted to the cut material (e.g. logarithm curves).

Obviously the cutting geometry is also influenced by the configuration of the cutting edges of the cutting knives. In addition, by increasing or decreasing the size of the cutting knife, it is possible to influence the change to the cutting angle between $S_1$ and $S_n$ ($\alpha_i$ as a function of $r_i$).

Importance is attached in all the constructions to the arrangement of the cutting faces of the cutting devices with respect to the printed products located on the circular path. The cutting face of the cutting devices in the case of cutting knives 14 or 15 corresponds to the plane of said knife. In the case of cylindrical cutting rollers 16, 18 or 19, the cutting face of the tangential surface corresponds to the generatrix of the cutting roller closest to the printed products. Obviously further cutting devices (e.g. rotary wires) are conceivable enabling the continuous cutting of the lateral edges of the printed products moved past them.

Other geometrical shapes can be used in place of the cylindrical cutting rollers. Thus, it is conceivalbe for the lateral cutting rollers 18 or 19 to be non-cylindrical and instead conical or frustum-shaped. The cylindrical roller 16, whose rotation axis is parallel to the rotary spindle 13 of drum rotor 11 to obtain a top cut at right angles to the lateral edges, ensures that the top of a printed product is substantially simultaneously cut over its entire length. If the top edge is to be cut continuously from one end to the other, then the represented cylindrical cutting roller can be replaced by a different rotationally symmetrical body, whose rotation axis is slightly inclined with respect to the rotary spindle 13. Assuming that the top edge of the printed products is to run parallel to the rotary spindle 13 of drum rotor 11, those points in which the cutting device cuts the printed product must be equidistantly spaced from the rotary spindle 13. The geometrical position of all these cutting points of a single edge corresponds to a cutout from a helix which, on slightly inclining the rotation axis, is similar to a planar elliptical cutout, which then corresponds to a generatrix of the rotating body of the cutting device.

Figure 7:
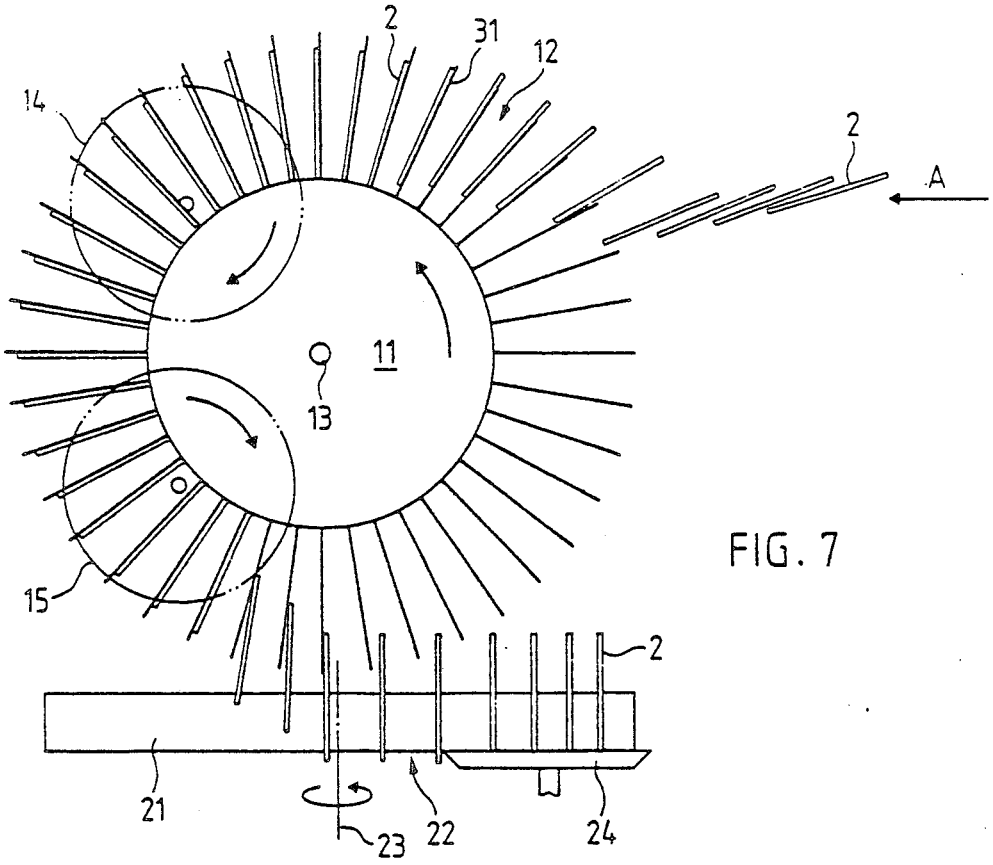
FIG. 7 is a side elevation of a further construction according to the invention for the multi-sided cutting of printed products.

An extended embodiment of an inventive apparatus is shown in FIG. 7. The apparatus initially comprises a first drum rotor 11, as well as two laterally arranged, rotating cutting knives 14, 15, as has already been described in conjunction with FIG. 2. Instead of directly conveying away the printed products after passing the two cutting knives 14, 15, they are transferred to a second, substantially identical drum rotor 21 with compartments 22. The rotation axis 23 of drum rotor 21 is preferably at right angles to the rotation axis 13 of the first drum rotor 11. By means of a further cutting knife 24, in the second drum rotor 21 it is now possible to cut the third edge of the printed product, normally that which is parallel to the fold or binding, so that with this apparatus the multilayer printed products can be cut in a single pass on three sides and clearly reveals the advantages of a cutting knife compared with a cutting roller.

A preferred construction and operation of the individual cells or compartments of the drum rotor will now be explained relative to FIG. 8*a*–8*h*. The representation is chosen in such a way that four different situations are shown from, in each case, two different viewing directions. The right-hand drawing shows a compartment 12, in which the viewing direction is from the side, i.e., parallel to rotation axis 13 of drum rotor 11, whereas the lefthand drawing shows the same compartment from the direction of arrow D i.e., in an end or peripheral view.

Figure 8A:
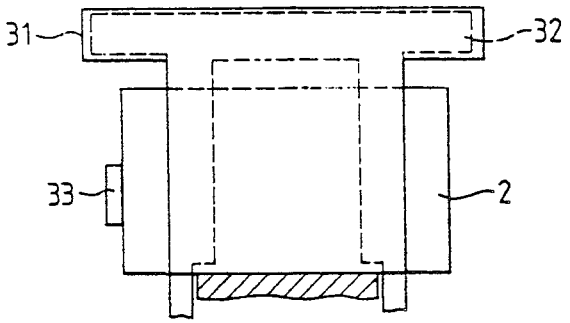
FIGS. 8*a*–8*h* are views of a sequence of positions of one embodiment showing the construction and operation of the individual cells or compartments of an inventive apparatus.
Figure 8B:
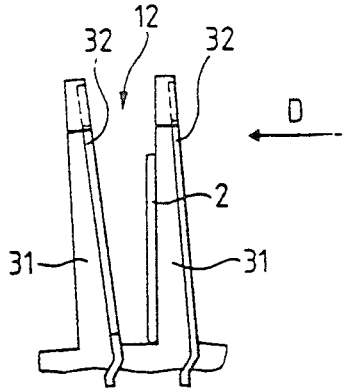
Figure 8C:
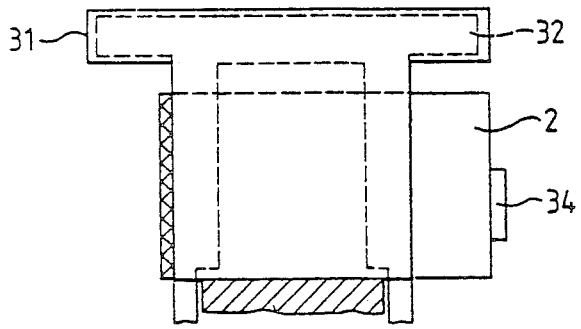
Figure 8D:
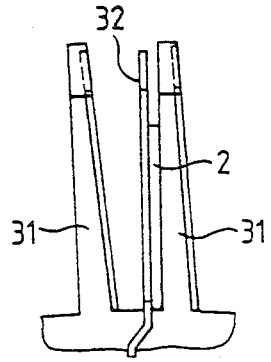
Figure 8E:
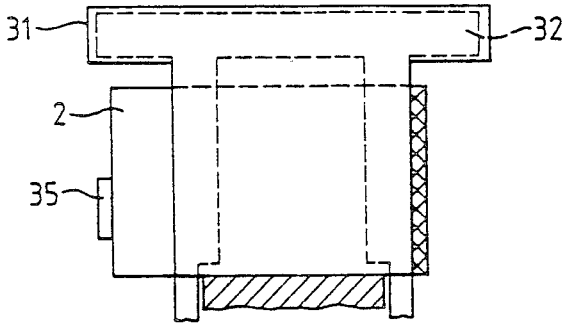
Figure 8F:
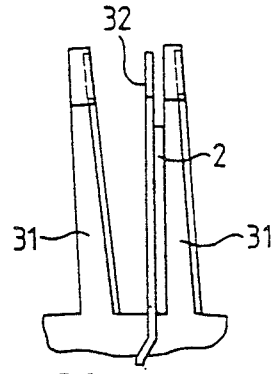
Figure 8G:
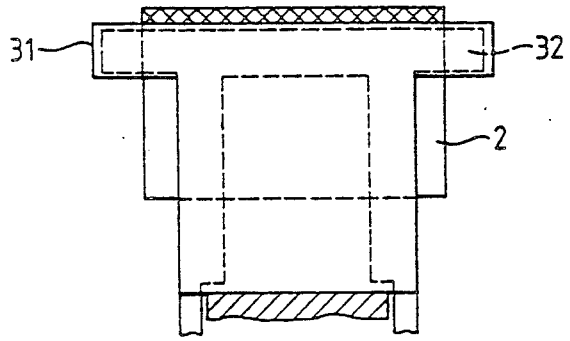
Figure 8H:
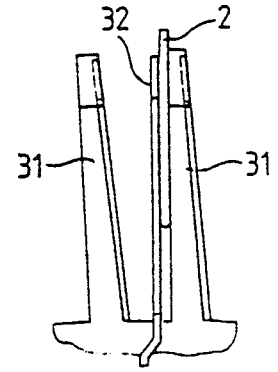

FIGS. 8*a* and 8*b* show a compartment 12 formed by two substantially radially oriented compartment walls 31, which also separate said compartment from the adjacent compartments. The compartment walls 31 are constructed in such a way that they simultaneously serve as counterknives on three sides. The compartment is provided with a clamping mechanism 32, which in FIGS. 8*a*, 8*b* is in the inactive state, in which it is located in a matingly constructed depression of the compartment wall 31, so that the printed product 2 can be inserted in the compartment. A straightening or aligning device 33 is used for so moving and orienting printed product 2 in compartment 12, that it assumes the necessary lateral position for the subsequent cutting process. The straightening device 33 is only shown diagrammatically. It is possible to adopt any arrangement permitting an orientation or alignment of the printed products in the compartments, e.g. a fixed cam, a revolving belt fastener, push rods, etc. (reference being made in this connection to FIGS. 9, 10 and 12). The shape and size of the clamping mechanism 32 are advantageously chosen in such a way that their outer edges substantially coincide with those of the compartment wall 31, i.e. with the edges of the counterknives. Thus, when the clamping mechanism is in the active state, i.e. the printed product 2, as shown in FIGS. 8*c* and 8*d* is fixed between the clamping mechanism 32 and the compartment wall 31, a completely satisfactory cutting process is ensured, because the printed product is held along the entire edge to be cut (in FIG. 8*b* the part to be cut off is shown in hatched form).

After cutting the first lateral edge and with simultaneous slight release of the clamping mechanism 32, the printed product 2 is oriented by means of a further straightening device 34 with the second, not shown cutting knife, after which the clamping mechanism is reactivated and the second lateral edge cut. In the sane way, the printed product is subsequently centered in compartment 12, e.g. by means of a further straightening device 35 and is so oriented that the outer edge can be cut.

In the previously described apparatus, the compartments have a specific, invariable size, while the printed products are moved in the compartments and oriented with the cutting mechanisms. However, a solution is also conceivable, in which the size of the cells is variable, so that the apparatus is adjustable to the particular format of the printed products to be processed. The cells or compartments can also be provided with separate, e.g. adjustable and/or interchangeable counterknives. It is also possible to provide the compartments, e.g. with cutting blades and to use fixed counterknives. The presently shown embodiment merely constitutes a preferred embodiment, which is characterized by particular constructional simplicity and corresponding robustness.

Figure 9:
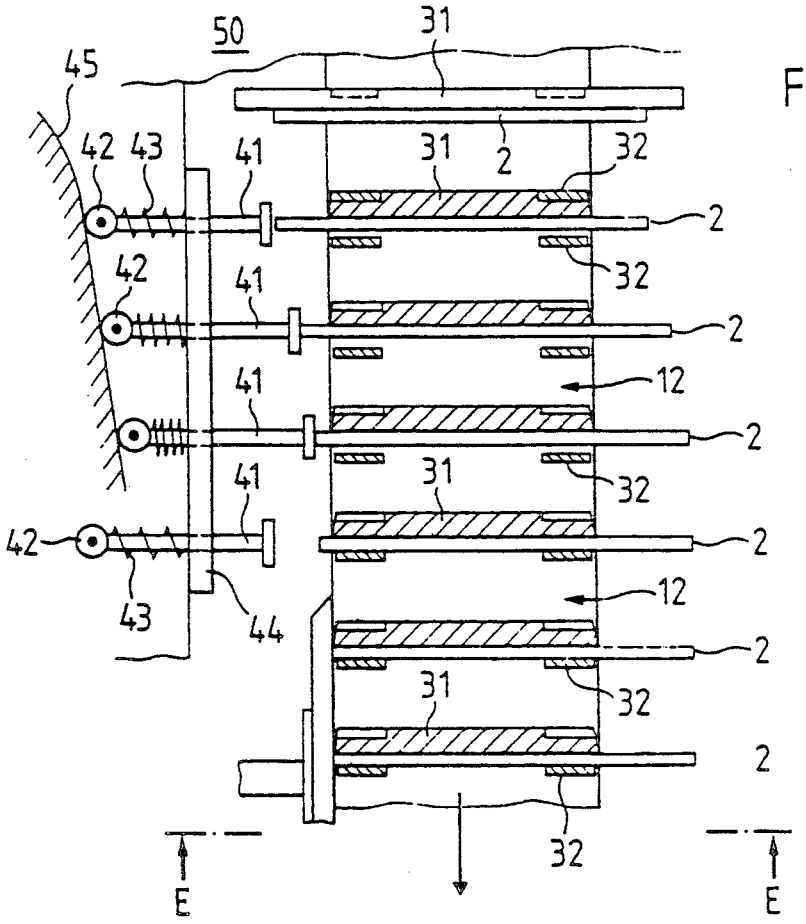
FIG. 9 is a schematic top plane view, in partial section, of a device for the lateral orientation of the printed products in the cells or compartments of the inventive apparatus.
Figure 10:
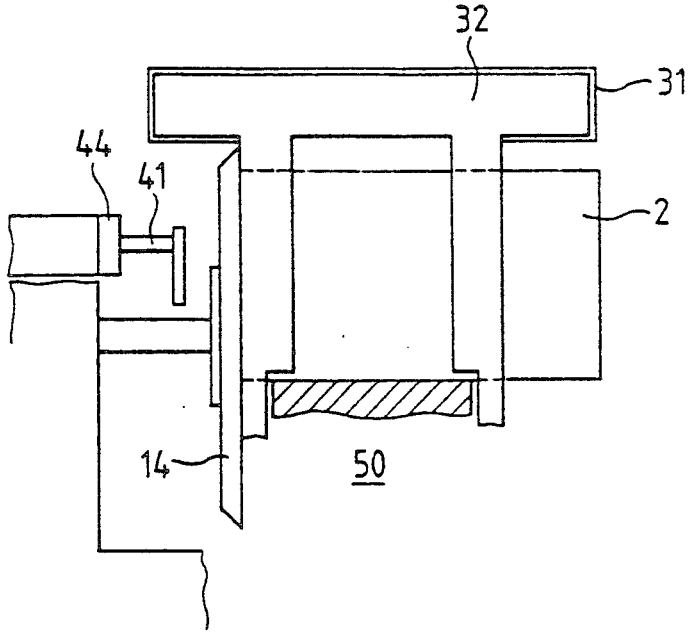
FIG. 10 is an end elevation of the apparatus of FIG. 9.

FIG. 9 is a partial section through an inventive apparatus, which is preferably provided with a casing 50, and shows a possible construction of a straightening device. The conveying direction is indicated by an arrow. Each of the compartments 12 has a movable, lateral push rod 41. The push rods 41 cooperate with a fixed cam surface 45, so that a lateral displacement of push rods 41 and consequently a corresponding displacement of the printed products 2 located in the compartments takes place. The push rods 41 are provided at the ends facing the link 45 with e.g. rolls 42 for minimizing frictional losses, a completely satisfactory contact between push rod and link being ensured by the restoring force of a spring 43, which cooperates with a lateral member 44 of the drum rotor. At the end of the link, i.e. when the printed product 2 is located in the desired position, push rod 41 is reset by the spring and the clamping mechanism 32 is activated, which now fixes the printed product, while it is moved past the cutting knife 14. FIG. 10 substantially shows a section along line E—E of FIG. 9, the viewing direction being opposite to the conveying direction.

Figure 11:
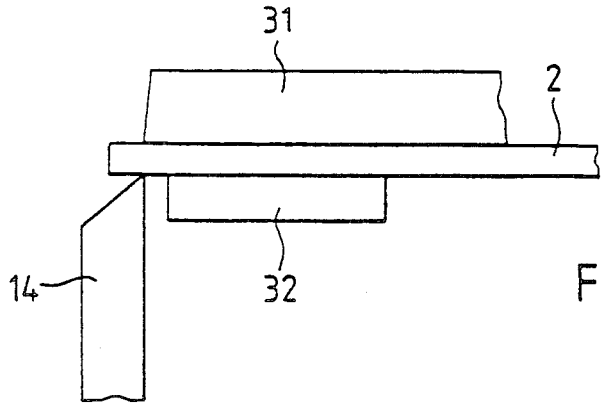
FIG. 11 is an enlarged detail of the cooperation of the cells or compartments with the cutting knives.

FIG. 11 shows a larger-scale detail of a compartment with a printed product 2 directly prior to the engagement of cutting knife 14. It is easy to see how the compartment wall 31 simultaneously serves as a counterknife for the cutting knife.

Figure 12:
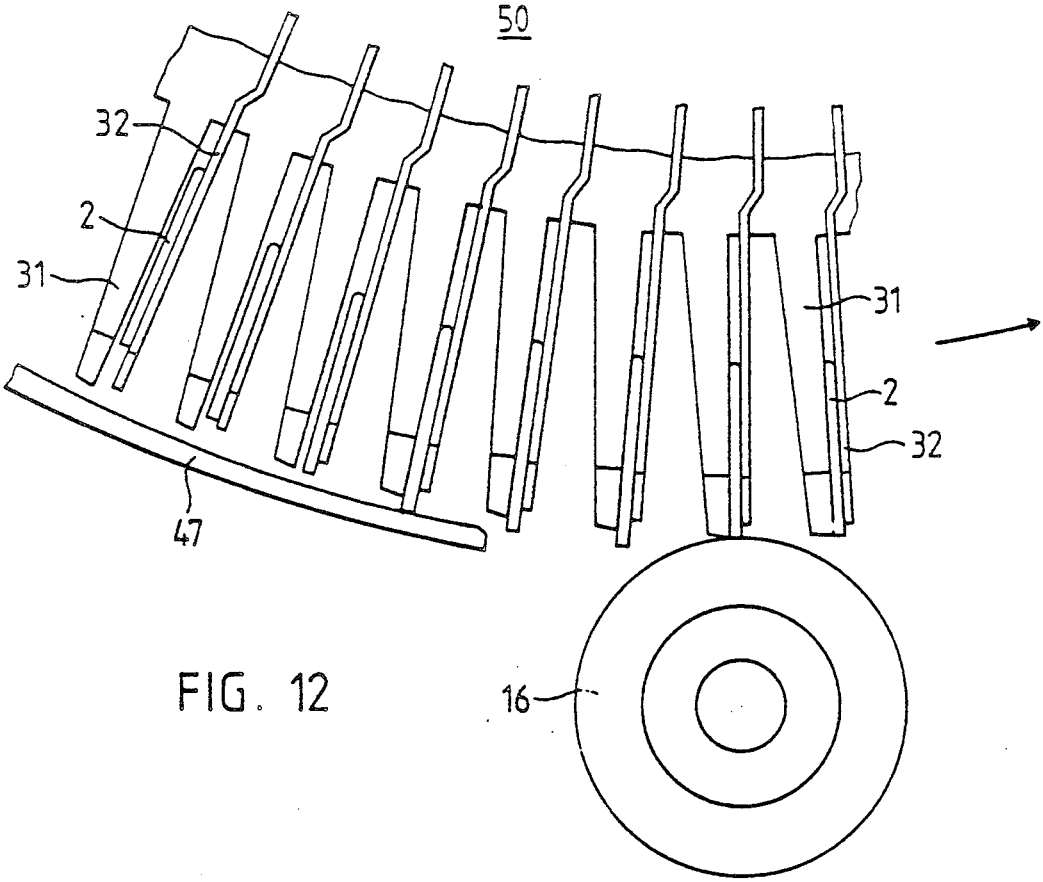
FIG. 12 is a partial side elevation of a device for the radial orientation of the printed products in the cells or compartments of the inventive apparatus.

A variant for orienting the printed products prior to the cutting of the outer edge by a cutting roller 16 (e.g. in an arrangement according to FIG. 2) is shown in FIG. 12 as a partial section through the drum casing 50 in side view, the conveying direction being indicated by an arrow. The clamping mechanism 32 is temporarily released, so that making use of gravity and/or centrifugal force, the printed products are moved against a fixed or rotating cam surface 47 and in this way assume a clearly defined position, after which the clamping mechanism is reactivated.

I claim:

1. A method for cutting continuously conveyed, multilayer printed products in a substantially continuous process comprising providing a plurality of first knife parts, positioning each printed product to be cut against one of the first knife parts, fixing each printed product and its associated knife part together along a selected edge of the product to be cut, providing a second knife part, moving one of the knife parts relative to the other so that the first and second knife parts cuttingly engage each other to cut the product along the selected edge, repositioning the printed product so that a second selected edge is adjacent a first knife part, fixing each printed product and its associated knife part together along the second selected edge of the product to be cut, and again moving one of the knife parts relative to the other so that the first and second knife parts cuttingly engage each other to cut the product along the second selected edge.

2. A method according to claim 1 wherein the plurality of first knife parts are moved along a defined path and the second knife part is maintained in a fixed position.

3. A method according to claim 2 wherein the step of moving is accomplished so that the selected edge is cut from one end of the edge to the other.

4. A method according to claim 3 which includes simultaneously cuttingly engaging a plurality of first knife parts and their associated products with one second knife part.

5. A method according to claim 4 and including adjusting the relative positions of the first and second knife parts to establish a distribution of cutting forces acting on each printed product.

6. A method according to claim 5 including adjusting the relative positions of the first and second knife parts to establish a correlation between the cutting speed and cutting angle for a specific printed product to be cut.

7. A method according to claim 6 and including cutting each printed product at right angles to a surface thereof.

8. A method according to claim 1 which includes simultaneously cuttingly engaging a plurality of first knife parts and their associated products with one second knife part.

9. An apparatus for cutting edges of continuously conveyed, multi-layer printed products comprising the combination of means defining a plurality of conveying units revolving about a closed path, each conveying unit receiving a printed product;

means on each conveying unit defining a plurality of counterknives;

means for positioning the product in each said conveyor unit so that a selected edge of said product is in engagement with one said counterknife;

first and second cutting knives;

means for mounting said first cutting knife at a fixed location along said closed path in a position to cuttingly cooperate with each said counterknife to sequentially cut said products along said selected edge;

means for repositioning said product so that a second selected edge of each said product is in engagement with a second said counterknife; and means for mounting said second cutting knife at a fixed location along said closed path in a position to cuttingly cooperate with each said second counterknife to sequentially cut said products along said second selected edge.

10. An apparatus according to claim 9 and further comprising a rotatable drum, said conveying units being supported on the periphery of said drum.

11. An apparatus according to claim 10 wherein said means defining said conveying units comprises a plurality of compartment walls extending radially outwardly with respect to a central axis of said drum so that said compartments are open outwardly and laterally.

12. An apparatus according to claim 11 wherein each of said compartment walls includes an edge defining a counterknife.

13. An apparatus according to claim 12 wherein each said cutting knife comprises a circular, rotatable disk having an axis substantially parallel to said central axis of said drum.

14. An apparatus according to claim 11 and further comprising a second rotatable drum having a plurality of conveying units supported on the periphery of said second drum, said second drum having an axis of rotation substantially perpendicular to the axis of rotation of said first-mentioned drum, said two drums being juxtaposed so that printed products can be transferred from the conveying units of said first drum to the conveying units of said second drum, said apparatus further comprising a third cutting knife mounted adjacent said second drum for cutting an edge of the products carried thereby.

15. An apparatus according to claim 9 wherein each said compartment further comprises means for clamping a printed product received in said compartment along said edge defining said counterknife.

16. An apparatus according to claim 9 wherein said means for positioning includes a cam surface along said path and means for engaging said cam surface and for positioning said product in said conveying unit relative to said counterknife.

17. An apparatus according to claim 9 wherein said cutting knife is dimensioned and positioned to simultaneously cuttingly engage printed products in a plurality of adjacent conveying units.

18. An apparatus according to claim 9 wherein said cutting knife is positioned relative to said counterknife to cut each printed product along said selected edge from one end to the other.

19. An apparatus according to claim 9 wherein the position of said cutting knife relative to the path of said counterknives is adjustable.

20. An apparatus for cutting edges of continuously conveyed, multi-layer printed products comprising the combination of a rotatable drum;

means defining a plurality of conveying units supported on said drum and revolving about a closed path, each conveying unit receiving a printed product, said means defining said conveying units including a plurality of compartment walls extending radially outwardly with respect to a central axis of said drum so that compartments defined by said walls open outwardly and laterally;

an edge on each of said compartment walls defining a counterknife;

means for positioning the product in each said conveyor unit so that a selected edge of said product is in engagement with said counterknife;

a cutting knife comprising a circular, rotatable disk having an axis substantially parallel to said central axis of said drum;

means for mounting said cutting knife at a fixed location along said closed path in a position to cuttingly cooperate with said counterknives to sequentially cut said products; and a second cutting knife, said second cutting knife including a rotatable cylinder having a generally helical cutting edge, said cylinder having an axis of rotation substantially perpendicular to said central axis of said drum.

21. An apparatus for cutting edges of continuously conveyed, multi-layer printed products comprising the combination of a rotatable drum;

means defining a plurality of conveying units supported on said drum and revolving about a closed path, each conveying unit receiving a printed product, said means defining said conveying units including a plurality of compartment walls extending radially outwardly with respect to a central axis of said drum so that compartments defined by said walls open outwardly and laterally;

an edge on each of said compartment walls defining a counterknife;

means for positioning the product in each said conveyor unit so that a selected edge of said product is in engagement with said counterknife;

a cutting knife comprising a circular, rotatable disk having an axis substantially parallel to said central axis of said drum;

means for mounting said cutting knife at a fixed location along said closed path in a position to cuttingly cooperate with said counterknives to sequentially cut said products; and a second cutting knife, said second cutting knife including a rotatable cylinder having a generally helical cutting edge, said cylinder having an axis of rotation substantially perpendicular to said central axis of said drum.

* * * * *